United States Patent [19]

Barber

[11] 4,276,959

[45] Jul. 7, 1981

[54] QUICK WAY SCAFFOLD

[76] Inventor: Ronald A. Barber, 519 S. Harrison St., West, Tex. 76691

[21] Appl. No.: 68,915

[22] Filed: Aug. 23, 1979

[51] Int. Cl.[3] ..... E04G 3/10; E04G 5/06

[52] U.S. Cl. ..... 182/150; 182/136; 405/195; 248/323; 248/340

[58] Field of Search ..... 405/196–199, 405/203–208, 195; 182/150, 136; 248/327, 340, 323

[56] References Cited

U.S. PATENT DOCUMENTS

| | | | |
|---|---|---|---|
| 1,823,385 | 9/1931 | Barker | 182/150 X |
| 1,929,325 | 10/1933 | Masterson | 248/323 |
| 2,706,662 | 4/1955 | Brown | 256/DIG. 6 |
| 2,925,240 | 2/1960 | Laviolette | 248/323 |
| 2,926,880 | 3/1960 | Bourgeois | 182/150 UX |
| 3,096,064 | 7/1963 | Leonard | 248/340 X |
| 3,480,257 | 11/1969 | Bourn et al. | 256/DIG. 6 |
| 3,660,871 | 5/1972 | Boyle | 256/DIG. 6 |
| 3,735,951 | 5/1973 | Reed | 182/150 X |
| 3,945,462 | 3/1976 | Griswold | 182/150 |

FOREIGN PATENT DOCUMENTS

| | | | |
|---|---|---|---|
| 377065 | 6/1964 | Switzerland | 182/36 |

*Primary Examiner*—Dennis L. Taylor
*Attorney, Agent, or Firm*—Gunn, Lee & Jackson

[57] ABSTRACT

In the preferred and illustrated embodiment, a scaffold is shown for attachment on the bottom side of an offshore drilling rig or platform. The scaffold is quickly installed and removed. It is fabricated with a set of upright hanger straps which, in turn, clamp to eye beams spanning the bottom side of the offshore structure. The hanger straps incorporate opposing hooks at the upper end. The central portion is comprised of an elongate strap or hanger, the length accommodating workmen. Each strap terminates at its lower end with a support to receive framing members such as horizontally deployed structural beams. The beams support deck planking arranged horizontally thereon and spaced from the bottom side of the offshore structure.

12 Claims, 6 Drawing Figures

QUICK WAY SCAFFOLD

BACKGROUND OF THE DISCLOSURE

This disclosure is directed to an accessory which materially assists and expedites the construction of an offshore platform. An offshore platform is defined for purposes of this disclosure as a permanent or semipermanent structure which is erected above the water surface at an offshore location. A permanent structure will utilize a superstructure above the water supported on a set of legs. Alternatively, it can be used with jackup drilling rigs which are portable, at least to the extent that they are moved from location to location between drilling jobs. Without regard to the manner of construction of the offshore platform, it avails itself of the present apparatus to enhance and expedite construction thereon. The construction which is referred to is not construction of the platform, itself; rather, it refers to construction of equipment on that platform. Typical equipment which is supported on the platform often includes pumps, valves, separators, a battery of storage tanks and the like. This type of equipment is normally found in a production platform. Alternatively, a fixed platform may be installed with drilling equipment on it, in which instance there will be a large number of mud tanks, mud pumps, a significant amount of superstructure and substructure for the drilling rig, itself, and other equipment.

The setting in which the present apparatus is used is one fraught with expensive hand labor in a dangerous environment. Typically, a platform will be formed at a shore location. Whether the platform is a permanent platform or a semisubmersible drilling rig, it is transported to a desired location at sea. The platform is then installed either temporarily or permanently. The platform so installed is normally installed with only the platform, but the operative equipment which is to be placed on it is normally attached only after the platform is made secure at sea. Thus, a large, fixed offshore platform will be assembled in parts (sometimes two or three major structural components) at a shore location, and the parts will thereafter be towed to sea for erection. At the time of erection, the platform is erected so that the deck is located significantly above the water and high above the wave action. At this time, the platform is actually devoid of drilling equipment or production equipment. It is merely a working surface for such equipment. The drilling equipment or production equipment, as the case may be, is thereafter installed on the platform. For instance, a barge supporting a crane will travel to the platform site, and, in conjunction with barge carried, fluid handling equipment, construction of the production or drilling equipment at the platform then occurs. Consider, as an easy example, well completion apparatus including a battery of tanks, a separator, valves and pumps. All of this equipment is carried by barge to the offshore platform. It is lifted by crane from the transportation barge to the platform. Thereafter, it must be plumbed by making suitable connections to the producing well and connections between the various components supported on the platform. A tremendous number of connections must be made. In many instances, the connections made are not permanent. They may be left intact for a few weeks or months and thereafter switched as the needs of the moment change. As an example, the platform may support both production equipment and drilling equipment. Later on, the drilling equipment may be removed and replaced with production equipment. Later on, the nature of the production may, itself, change, and new production equipment may be required. In every instance, it is necessary to disconnect and perhaps reconnect (via plumbing) the equipment at the platform.

The foregoing provides a setting or context in which the problem met by the present apparatus is assisted through the implementation of this apparatus. Thus, one advantage of the present invention is that it accommodates and expedites installation of equipment at the platform. As an example, if a tank battery is placed on the platform, it may be necessary to make a large number of connections through the platform floor, along the bottom side and back up through the floor to interconnect the various tanks in the tank battery. As this occurs, the platform is cut many times, and various and sundry hangers are connected on the bottom side to support the various pipes, valves and other equipment. Most of the plumbing is installed on the bottom side because the top surface is reserved for the equipment supported on the platform and at least a minimum area for workmen. Accordingly, the platform is perforated at many locations, and a great number of pipes will be hung from the bottom side. This occurs in a random manner, and, accordingly, the bottom side of the platform, after the platform has been replumbed two or three times, becomes a veritable forest of odd sizes and shapes of scaffoldings, miscellaneous hangers and the like. This makes working on the bottom side of the platform difficult to set up and difficult to conduct. All kinds of jerry-rigged scaffolding devices have been used heretofore.

From the foregoing, it will be observed that the bottom side of the platform becomes so littered with cut off pieces of scaffolding, old connectors, pipes no longer in use and operative plumbing and pipes that convenient access is almost impossible to obtain. The present invention overcomes this handicap in that it provides a system for rigging scaffolding beneath a plaform which leaves the platform intact after the scaffolding has been removed. Moreover, it can be installed quickly and easily without welding. One advantage is, therefore, the speed with which installation is made, and removal is implemented when desired. The scaffolding of this disclosure is advantageous over competitive types of scaffolding which have primarily been structures of convenience, typically tack welded to the bottom side of the platform at some location. The installation of temporary scaffolding heretofore has simply littered the bottom side of platforms so that accessibility is thereby limited after erection of scaffolding several times.

This disclosure sets forth an improved scaffolding system which is temporarily installed and subsequently removed without damaging or harming the platform structure. It has the advantage that it can be used incrementally; by that, reference is made to the fact that the scaffolding can be installed to provide a small or a very large work area. In the event a large work area beneath the platform is desired, this invention furnishes a scaffolding which is extended by merely repetitively utilizing the same apparatus to support a larger surface area. This carries with it the benefit of uniformity. The uniform structure enables rather rapid fabrication and disassembly.

A further advantage of the present apparatus is that its connection to the platform does not leave any debris in the form of welded plates scattered at random across the bottom side of the platform. After removal, the only thing remaining on the bottom side of the platform is the plumbing and other pipes which are installed beneath the platform with the equipment on it. However, the scaffolding, itself, is fully removed.

With these advantages and objects in mind, the present apparatus is briefly summarized as an accessory to be attached to the nether side of a platform at an offshore location. It utilizes hanger straps which are elongate straps terminating at a pair of facing hooks at the upper end which clamp to beams in the platform structure. They terminate at support plates which, in turn, hold up scaffolding beams, enabling construction of planking into decks of an extent determined by the number of hangers and beams installed in the scaffolding. It is installed by temporarily connecting the hanger straps to the platform. It is removed by disconnecting them. They connect and disconnect through manipulation of a pair of facing hooks.

DETAILED DESCRIPTION OF THE ILLUSTRATED EMBODIMENT

Figure 1:
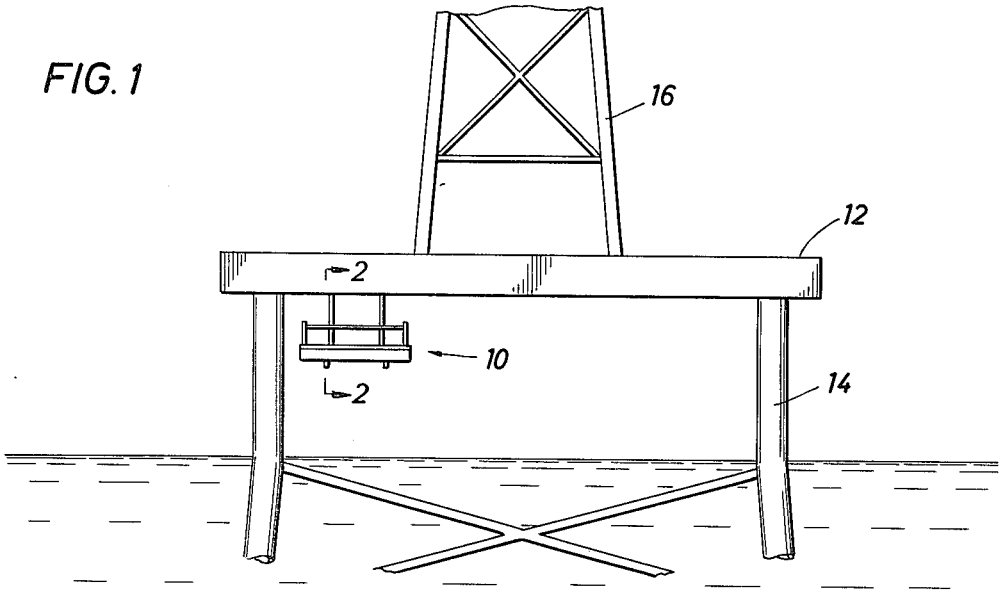
FIG. 1 shows the scaffolding of the present invention installed beneath a platform at an offshore location.

Attention is first directed to FIG. 1 of the drawings, where a platform 12 supports the scaffolding 10 of the present invention. The platform 10 depicted in FIG. 1 includes a plurality of legs 14. Equipment is rested on the top of the platform. A representative set of equipment is a derrick 16. In that instance, the platform is being used to support drilling equipment. The equipment is representative; the equipment on the platform may well be different, as, for example, production equipment including tanks, pumps, separators and so on. The nature of the equipment supported on top of the platform is not critical to this disclosure. Its importance lies primarily in the fact that it is supported on top of the platform and typically must be interconnected and also connected with the producing well by means of pipes and other materials typically strung beneath the platform. The term "plumbing" as used hereinafter thus refers to the pipes, valves, fittings and the like which are affixed to the equipment on the platform and which are typically located beneath the platform. The plumbing is typically underneath the platform to avoid crowding the surface. This enables some room to be left for walkways and service personnel on the platform. The present invention can be installed on a permanent platform (a platform which is supported on legs which are fixed to the ocean bottom) or a movable platform. One form of movable platform is a jackup drilling rig which is a platform supported on three or more legs and equipped with a mechanism for raising the platform on the legs.

Figure 2:
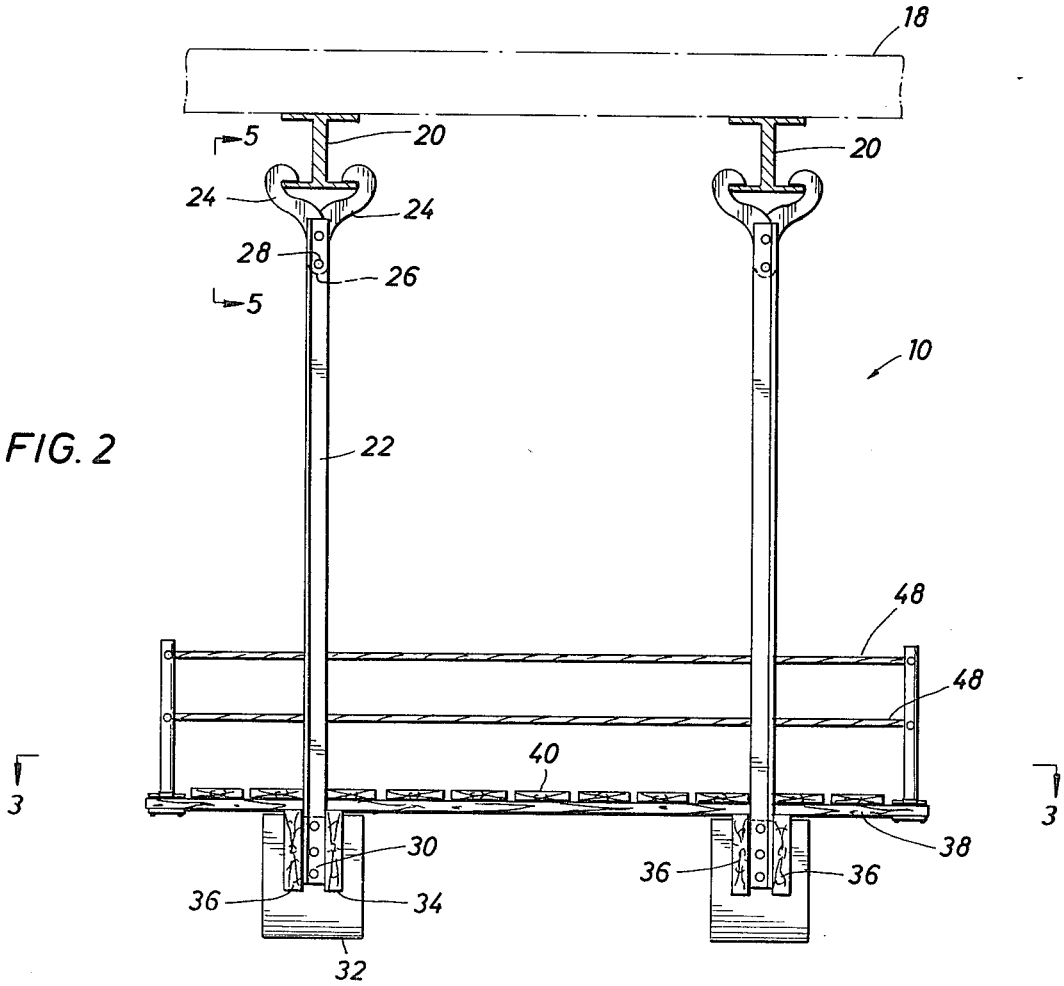
FIG. 2 is an enlarged view along the line 2—2 of FIG. 1 showing the scaffolding of the present invention and its connection to the bottom side of a platform.

The platform 12 is customarily erected with structural members in it. In FIG. 2 of the drawings, a typical horizontal structure member 18 supports generally horizontally deployed eye beams 20. The eye beams 20 span the equipment at evenly spaced locations. Several eye beams are included, and they are typically identical in size and shape. The typical eye beam is constructed with suitable edge located flanges. Moreover, they are located at regularly spaced locations so that the beams 20 are available systematically across the bottom side of the platform to support the scaffolding 10 of this disclosure. The beams 20 are called "eye" beams to avoid confusion in print; traditonally, they have also been identified as "H" or "I" beams.

The structure of FIG. 2 is supported beneath the beam 20. The size of the beam is subject to variation in accordance with scale. For instance, it might be a six-by-eight-inch beam. It could be larger or smaller. If it is larger, they are typically installed on larger platforms and may well be spaced further apart. The particular spacing chosen at the time of fabrication of the platform is not critical to this disclosure. This disclosure, however, presumes that the platform is supported on a set of beams and that they are ordinarily regularly spaced and ordinarily have approximately the same size or dimensions.

For a given beam, it is used as a support for the scaffolding 10. To this end, this disclosure incorporates a hanger strap formed of elongate, angle iron stock at 22. The length will be described later. The hanger strap 22 is constructed of angle stock and terminates at a pair of hooks 24. There are two hooks at each hanger strap 22, and they are preferably identical. They are identical, but they are positioned in facing, opposing pairs. Thus, two hooks 24 cooperate with one another to function somewhat in the form of a pair of tongs to clamp around the beam 20. The clamping action is achieved by positioning one of the hooks on one side of the beam, while the other is positioned on the opposite side. The two hooks together clamp around the edge located flange plate which defines the beam 20. They face one another and, therefore, clamp toward one another. This provides a safe interconnection of the two hooks 24 so that they do not slip free of the beam 20. Moreover, each hook terminates in a shank 26 which is attached by means of removable bolts 28. Several bolts, but at least two in number, are installed, and they are bolted to the hanger strap 22. This is at the upper end of the hanger straps as shown in FIG. 2.

Figure 5:
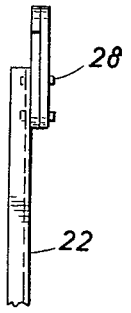
FIG. 5 is an enlarged, detailed view taken along the line 5—5 of FIG. 2 showing the opposing hooks and hanger strap in detail.

Attention is momentarily directed to FIG. 5, where the two hooks 24 are shown fastened to the hanger strap 22 by the bolts 28. The bolts 28 pass fully through the two hooks. If desired, one of the bolts can be made permanent, and, to this end, an upset rivet can be used to serve more in the fashion of a pivot. The other of the two bolts serves as a fastener which pulls the two hooks together to the desired spacing. Needless to say, more than two bolts can be used. It is significant to note that the two hooks close toward one another in a manner sufficient to clamp onto the beam beneath the platform floor. An important factor of the present invention is the safety which is obtained by clamping the hanger strap to the overhead eye beam.

The eye beam 20 thus serves as a load bearing member for the scaffolding 10 of this disclosure. It is load bearing in the sense that the weight of the scaffolding is supported by the hanger strap (there being several in a typical installation), and they, in turn, all rest their weight on the beams in the platform.

The hanger strap 20 shown in FIG. 2 has a specified length. Typically, the strap is used in multiple quantities at a given location, and they are all equal in length. A typical length is in the range of 10.0 feet. In other instances, the hanger straps may be longer or shorter depending on vertical clearance beneath the platform. In any case, the hanger strap 22 is comprised of a substantial length of angle iron stock and is connected at its lower end by means of bolts or rivets 30 to a support plate 32. The support 32 is an upstanding, transverse plate which has a first notch 34 formed on one side and a second and similar notch 34 formed on the other side. The notches 34 are adjacent to the hanger strap 22 so that the hanger strap 22 serves to directly support horizontal scaffolding beams 36. The scaffolding beams 36 are not ordinarily similar to the beam 20. The beam 20 is typically a permanent installation, namely, a part of the platform which is exposed to the weather and elements even after the platform is rigged with equipment and left unmanned at sea. The beams 36 are used to support the scaffolding and are typically, although not always, formed of wood, and they are installed for subsequent disassembly. They constitute a removable component in the scaffolding 10. At the time of erection of the scaffolding, the hanger strap 22 is supported beneath one of the beams 20. It has a support plate 32 located at a specified datum level beneath the platform. Upon installation of two or more hanger straps 22, a beam 36 is then aligned with two or more support plates and positioned in the upfacing notches. So to speak, a beam is then rested at two or more points of support. The horizontal beam 36 is thus structurally fixed in location and held horizontally by the hanger straps 22 cooperative with the support plates 30.

In assembly of the scaffolding 10, the lateral extent will be ignored. A first hanger strap 22 is affixed overhead, and a second is hung parallel to the first. They are aligned so that the support plates 32 will support a common scaffold framing member 36, typically in the form of a wooden beam having dimensions in the range of perhaps 2.0 inches by 10.0 inches. The use of nominal wood stock is permissible in these circumstances.

The several beams 36 are assembled. As shown in FIG. 2 of the drawings, a runner 38 is installed over the several beams. The runner 38, in turn, supports deck planking 40. Deck planking at 40 defines a walking area where the craftsmen can walk on the scaffolding with safety.

Figure 3:
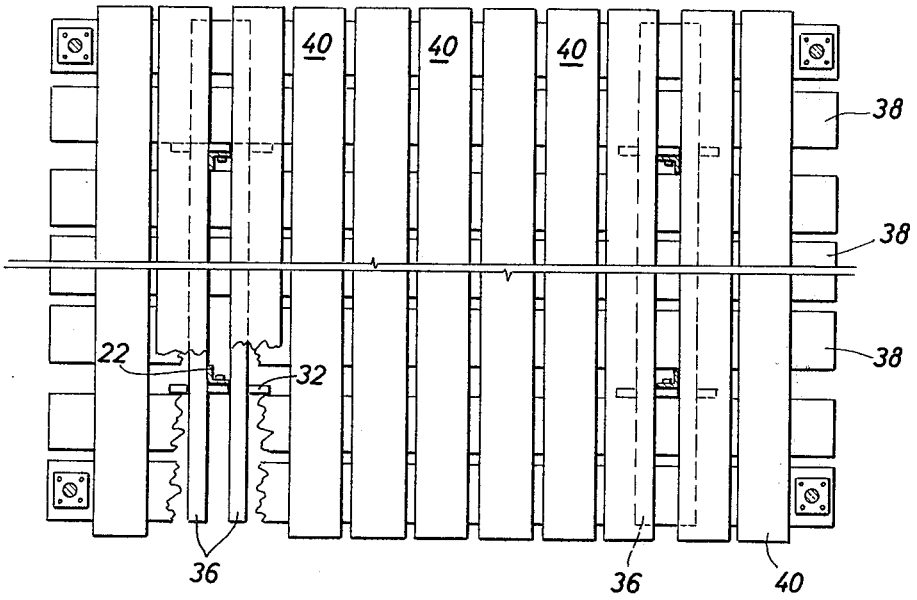
FIG. 3 is a plan view of the scaffolding shown in FIG. 2 which describes details of construction of the decking formed thereon.

Attention is next directed to FIG. 3 of the drawings, where several runners 38 are shown preferably parallel to one another and spaced relatively close to one another. They, in turn, support deck planking 40. Several planks are used. The spacing between deck planks is relatively small. Small gaps are left so that unusually high wave action will pass through the scaffolding. They are preferably spaced close to one another so that workmen will not ordinarily be apprehensive about looking through slots or cracks in the scaffolding to the ocean below. Moreover, the gap between deck planking boards 40 is kept relatively small so that hand tools and the like will not fall through slots or cracks in the scaffolding. FIG. 3 further shows the upstanding hanger straps 22 in section. As shown in FIG. 3 of the drawings, the scaffolding is formed of the several structural layers formed together to define the scaffolding as a whole. As an example, the beams 36 are quite long, and they are supported on many support plates 32. Where a particular beam 36 is inadequate in length, it can be spliced to a similar beam at the time of assembly so that the beam has continuity. Shorter beam portions can be used, provided they are supported on two or more support plates 32.

The same is also true of the runners 38. They preferably pass over several of the beams 36. It will be observed that the latter two members are mutually perpendicular to one another. That is, all of the beams 36 collectively are parallel and are mutually perpendicular to the runners 38. In turn, deck planking 40 is placed on top, and it is mutually perpendicular to assure that the structure has adequate strength.

Figure 4:
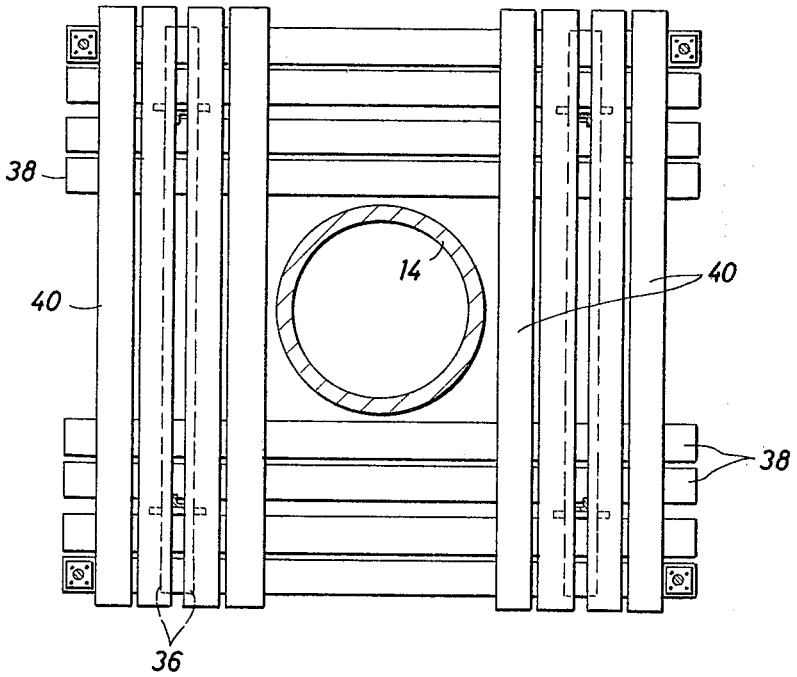
FIG. 4 is a view similar to FIG. 3 showing the arrangement of the scaffolding around a leg of the platform.

Attention is next directed to FIG. 4 of the drawings. There, a leg 14 of the platform is shown. The platform has been built around the leg. Sometimes, this is desirable; at other times, the platform shape requires that the scaffolding 10 be built elsewhere beneath the rig. It may be clear of the leg. In any case, it can be positioned adjacent to a leg by constructing the scaffolding 10 around a particular leg. In the instance illustrated in FIG. 4 of the drawings, the several runners 38 are interrupted so that the leg is able to pass between two sets of runners 38. Moreover, the deck planking is also arranged in this fashion, namely, in two sets which are parallel to one another and which are spaced sufficiently apart to encompass the leg 14. If desired, a safety rope can be erected around the opening left to accommodate the leg 14.

Figure 6:
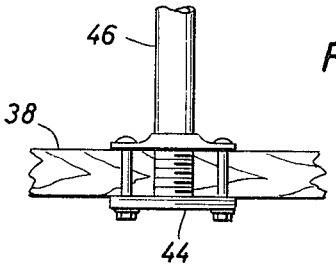
FIG. 6 is a detailed view showing a safety fence around the edge of the scaffolding.

FIG. 6 of the drawings shows a safety device. A suitable safety fence is erected. At given locations on the runner 38, it is drilled, and a mounting bracket 44 is used to attach a post 46. Several bolts are utilized to attach the post 46. The post is in an upright position, and, in turn, it supports a set of safety ropes 48. Several are included, and they are typically located around the edge of the platform. Any holes which are left in the scaffolding are, likewise, fenced off for purposes of safety. FIG. 4 shows one such hole which is left in the scaffolding, and, if desired, it can be fenced with a safety fence.

At the time of installation of this apparatus, the bottom side of the platform is cleared to the extent possible of previous scaffolding supports and the like. Ideally, the area is clear, although this is not essential. There may, in fact, be preexistent plumbing located beneath the platform which requires additional plumbing. In any event, the hanger straps 22 are first installed by the pinchers movement of the two hooks at the top end. As they pinch around the overhead beam, they are fastened securely. Fastening occurs at the two hooks, namely, by bringing them into the closed or hooked position of FIG. 2. This is achieved by appropriately connecting the bolts 28 to the shanks 26 of the hooks. They are fastened, and the act of fastening fixes their opening. This prevents pulling free of the platform.

The next step in assembly of the scaffolding 10 is to support the horizontal beams 36 on the support plate 32. Several are used, and this, in turn, throws the weight of the scaffolding on all the hanger straps. To this end, it is highly desirable to make the straps approximately equal in length to avoid overloading any particular strap.

The next step is installation of the runners 38 and the deck planking 40. These are applied in regular or orderly fashion across the scaffolding. Where any particular board terminates as a result of shortness of length, it is possible to splice an identical board to it. Such a splice is normally made by simply nailing a pair of abutted boards with a splice across the junction. Thereafter, the two boards can be used as a single board.

The present apparatus, after installation, typically requires the safety fence around the periphery. This is easily installed as, for example, by installing the fence post 46 as shown in FIG. 6. Ropes are strung, and safety is markedly enhanced by this rigging.

The present invention may be left beneath the platform for weeks, months or years. The only limitations which occur to the duration generally relate to safety. For instance, the platform should perhaps be removed or at least evacuated in the event of very high seas. If wood is used for construction of the scaffolding, it, too, should be periodically inspected to determine the degree of rot resulting from its exposure to high humidity above the body of water. Treated wood lasts longer and is, therefore, recommended where the installation must be of long duration. The platform, when installed, enables workmen to have access to plumbing and other equipment installed beneath the platform 12. The workmen are able to move around and to have their equipment with them, such as welders, hand tools and the like. Moreover, various and sundry quantities of pipe can be carried on the scaffolding 10 for easy installation from the bottom side of the platform.

At the time of removal, the platform is left substantially unaltered from its original condition. This invention does not require welding of unwanted parts or components which clutter the nether side of the platform.

The present apparatus is an expedient in that it achieves installation of the platform in rapid order, thereby reducing time delays and cost of personnel. The value of platforms is quite high; any delays which result from the installation of scaffolding are reduced, and funds are saved thereby. Moreover, the personnel can install the scaffolding much more rapidly and with a greater degree of safety. It can be installed substantially without welding. To the extent that welding occurs, it is sometimes dangerous because there might well be escaping gas in the near vicinity.

The scaffolding of this disclosure is readily expandable. In a first example, assume that the scaffolding is to have an area of 20.0 feet by 30.0 feet. On the next installation, assume that the scaffolding is to be twice the size of the first installation. This is easily accommodated on installation of the scaffolding at each occurrence.

While the foregoing is directed to the preferred embodiment, the scope of the present invention is determined by the claims which follow.

I claim:

1. A scaffold structure adapted to be rigged beneath and supported from a set of horizontal beams comprising:

(a) upright hanger strap means defining a pair of spaced apertures at the upper end thereof, said strap means having a central elongate portion of specified length extending downwardly from said hook means and terminating at a lower end beam support means;

(b) a pair of oppositely facing hook elements each having a hook portion for engagement with a flange of a beam and each defining a downwardly extending shank having spaced apertures formed therein;

(c) a pair of bolts extending through said apertures of said shank portions of each hook element and extending through said apertures of said hanger strap means and securing the same in immovable assembly with said strap means;

a beam extending between a pair of upright hanger strap means rested on said beam support means, said beam having an extent enabling a deck to be positioned thereon; and wherein at least two of said upright hanger support means cooperatively support said beam spaced below a platform by a distance determined by the length of said strap means.

2. The apparatus of claim 1:

wherein said hook shanks are load bearing members connected to said strap means.

3. The apparatus of claim 2 wherein said strap means is connected to said hooks by bolts through said shanks and said strap means.

4. The apparatus of claim 1 wherein said beam support means comprises a structural support plate having upfacing receptacles therein profiled to receive said beams therein and wherein said plate is fixedly attached to said elongate strap means.

5. The apparatus of claim 4 wherein said beam supports a deck thereon, and a safety fence stands above said deck.

6. A method of placing a scaffolding beneath a platform, where the platform incorporates a plurality of horizontal beams exposed on its nether side and having lower flanges, the method comprising the steps of:

(a) providing a plurality of elongate hanger strap means;

(b) positioning first hook means in assembly with the upper end of said strap means and positioning said first hook means in supporting engagement with one of said lower flanges of said beams;

(c) positioning second hook means in oppositely facing relation with said first hook means and in supporting engagement with the opposite lower flange of said beams and in assembly with said upper end of said strap means;

(d) fixing said first and second hook means in assembly with said upper end of said strap means and simultaneously locking said first and second hook means in supporting assembly with said flanges of said beams;

(e) placing a beam on the beam supporting means and extending the beam in length and in quantity of beams in a common plane to encompass an area sized to define a scaffolding area; and (f) placing a deck on the beams.

7. The method of claim 6 including the step of pivotally mounting the hook means for opening and closing and fixing the opening thereof by releasably installing a bolt to close the hook means.

8. The method of claim 6 including the step of releasably clamping at least two suspended elongate strap means to position at least a pair of beam supporting beams aligned with one another so that a common beam is thereafter placed in the beam supporting means.

9. The method of claim 8 including the subsequent step of installing another pair of suspended elongate strap means aligned so that at least a pair of beam supporting means receive and support a second beam which is parallel to the first beam and further wherein said first and second beams are at the same relative elevation beneath the platform, and thereafter installing the deck on the beams in a horizontal plane.

10. The method of claim 9 wherein the scaffolding area is extended indefinitely by repetitively installing at least pairs of the suspended elongate strap means to support additional beams in a common plane with the first and second beams.

11. The method of claim 10 including the step of erecting a safety rope on upstanding posts around the edge of the deck.

12. The method of claim 11 wherein the erection includes the step of fastening an upright post around a peripheral edge of the decking and extending a horizontally deployed safety fence therefrom along the edge of the deck.

* * * * *